US006895884B1

(12) United States Patent
Velázquez

(10) Patent No.: US 6,895,884 B1
(45) Date of Patent: May 24, 2005

(54) ANCHORING SYSTEMS AND METHODS FOR ANCHORING AN OBJECT

(76) Inventor: Victor Eli Velázquez, P.O. Box 8538, Humacao, PR (US) 00792

( * ) Notice: Subject to any disclaimer, the term of this patent is extended or adjusted under 35 U.S.C. 154(b) by 0 days.

(21) Appl. No.: 10/789,855

(22) Filed: Feb. 27, 2004

(51) Int. Cl.[7] ..... B63B 21/26
(52) U.S. Cl. ..... 114/295
(58) Field of Search ..... 114/293, 294, 114/295; 52/157, 155, 156, 158

(56) References Cited

U.S. PATENT DOCUMENTS 3,262,412 A * 7/1966 Dantz ..... 114/295
3,399,646 A * 9/1968 Vincent ..... 114/295

* cited by examiner

*Primary Examiner*—Jesus D. Sotelo

(57) ABSTRACT

The present invention is a novel anchoring system comprising: a housing; a connector that connects the housing to an object; at least one motor which is contained within and fixed to said housing; and at least three movable elongated members, each having a proximal tip, a distal tip, a retracted storage position and an extended operative position relative to the housing. Each elongated member is operably linked to at least one motor, and an elongated member is essentially contained within the housing when said elongated member is in a storage position and the elongated member extends away from the distal surface of said housing into a penetrable environment when the elongated member is in an extended operative position.

16 Claims, 10 Drawing Sheets

ANCHORING SYSTEMS AND METHODS FOR ANCHORING AN OBJECT

FIELD OF THE INVENTION

This invention relates to the field of anchors that immobilize or restrict the movement of an anchored object. Some embodiments of the invention are particularly useful for anchoring a boat or other floating object to a desired region of the floor of a body of water. Other embodiments anchor a tree, an electric pole, a tent, any land vehicle (e.g., tractor, fireman's ladder truck, derrick, mobile home), an animal (e.g., horse, cow, dog, elephant, camel), a building, a wall, or a bridge.

BACKGROUND OF THE INVENTION

Man has anchored boats, tethered beasts, stabilized man-made structures, and attached objects to walls and ceilings since the dawn of time. To this end, he has invented a wide variety of devices for immobilizing objects.

The first water anchors were simply heavy stones attached to vessels by ropes. Later anchors were made of wood, and then metal, and were variously shaped to better burrow into the seabed and to clasp underwater rock formations. Alternatively, vessels were also tethered to fix posts anchored to land, for example dock pylons.

A number of designs for anchoring boats and other objects have been reported. U.S. Pat. No. 3,187,705 describes a boat anchor having an internally mounted shaft to penetrate the ocean floor with outwardly extending legs for embedding within the floor and maintaining secure anchoring. U.S. Pat. Nos. 4,960,064, 5,613,458, and 6,606,829 disclose a spike-like anchor having a drive anvil and hammer; the pointed lower end of an anchor rod is placed in contact with the ground and the hammer repeatedly strikes the drive anvil, driving the anchor rod into the ground. U.S. Pat. No. 3,427,812 discloses an apparatus for securing a pipe to the earthen surface underlying a body of water, which includes an anchor-driving device and an anchoring assembly. U.S. Pat. Nos. 3,841,105, 3,479,830, 4,389,034, 4,492,493, 5,730,552 and 6,066,015 disclose the use of screw-type elements that are embedded into the earth's surface underwater. U.S. Pat. Nos. 4,265,566, 4,626,330, 5,653,069, 5,881,978 and 5,934,839 disclose various types of anchors driven into the earth's surface underwater and on land. U.S. Pat. No. 5,501,551 describes anchors having a radially expansible shell. U.S. Pat. Nos. 4,634,326 and 5,439,330 describe anchors having an expansion member.

Existing water anchors have several disadvantages. They typically must be blindly dragged through a seabed, wreaking havoc to undersea habitats such as coral colonies, until an anchor either sinks in the sand or grips a rock. It is frequently frustratingly necessary to attempt to set an anchor several times before succeeding. All too often, wind or current moves an anchored vessel and dislodges the anchor, thus unpredictably setting the vessel dangerously adrift. Lifting anchor can be problematic because current anchors, once lodged, tend to hold fast, and often it is necessary to cut the line and lose the anchor. When successfully retrieved from the bottom of a body of water, conventional anchors typically carry mud, grass or other debris up with them. The debris must at the least be cleaned from the boat, and at the worst may damage the boat or any items inside the boat.

As will be seen more fully below, the present invention is substantially different in structure, methodology and operation from that of known anchors. This invention overcomes noted disadvantages of prior water anchors. Certain embodiments are also useful for anchoring a variety of objects on land.

SUMMARY OF THE INVENTION

The present invention is generally drawn to an anchoring system, comprising:

- a housing (2) having a distal region (2*b*), a proximal region (2*a*) and an interior region (4);
- a connector (7) attached to the housing (2), wherein said connector (7) connects the housing (2) of the anchor (1) to an object;
- at least one motor (9) which is contained within and fixed to said housing (2), wherein said at least one motor (9) is operably linked to at least one power source (10);
- at least two movable elongated members (11), each having a proximal tip (11*a*), a distal tip (11*b*), a retracted storage position and an extended operative position relative to the housing (2), wherein each elongated member is operably linked to at least one motor (9), and wherein an elongated member is essentially contained within the housing (2) when said elongated member is in a storage position and the elongated member extends away from the distal surface (2*b*) of said housing (2) into a penetrable environment when the elongated member is in an extended operative position;

wherein said at least one motor (9) causes an elongated member to move from a storage position to an extended operative position and from an extended operative position to a storage position.

The anchors generally have between two and twenty elongated members (11) that can be deployed individually or in groups of three, four, five or six. Certain embodiments of the elongated members (11) are screw-shaped. Certain embodiments of the elongated members (11) are telescoping screws having multiple layers, each inner layer having on its outermost side surface spiral threads that "mate with" or engage spiral threads present on the innermost surface of an immediately surrounding layer. Some screw-shaped elongated members (11) contain modified distal tips (11*b*) that are specialized for penetrating into a particular (e.g., sandy, soft, brittle, hard or rocky) penetrable medium.

The number of motors (9) ranges from one to a number that equals the number of elongated members (11) plus one. When there is more than one motor (9), they may be of different kinds (e.g., electrical, hydraulic, etc.) or the same kind. These motors may be activated through direct wire links or by remote control (in which case the anchor (1) further comprises a receiver for receiving a remote signal).

The anchoring system can include at least one sensor such as a camera (13) to visualize unseen remote regions, to locate favorable anchoring sites and avoid unfavorable ones, and to correctly position and deploy an anchor at a desired location. The invention may also comprise at least one light to illuminate a remote site so a camera (13) can image it, and at least one beacon for marking the location of the anchor.

BRIEF DESCRIPTION OF THE FIGURES

FIG. 2 depicts side views (FIGS. 2*a*–2*c*) and bottom views (FIGS. 2*d*–2*f*) of a roughly hemispherically shaped embodiment of the invention (motors are omitted to avoid clutter) having six fully stowed (FIGS. 2*a*, 2*b*, 2*d*, and 2*e*) or fully deployed (FIGS. 2*c* and 2*f*) elongated members (11). FIGS. 2*a*, 2*d*, 2*c* and 2*f* are exterior views, whereas FIGS. 2*b* and 2*e* show on way for arranging stored elongated members (11) within the housing (2).

FIG. 3 depicts alternate embodiments of the invention (motors are omitted to avoid clutter). FIG. 3*e*, top lateral view; and FIG. 3*f*, bottom lateral view).

FIG. 4 illustrates screw-shaped elongated members (11).

FIG. 5 exemplifies relative placement of housing (2), connector (7), motor (9) and movable elongated members (11), particularly illustrating how a motor (9) moves a screw-shaped elongated member.

FIG. 6 illustrates telescoping screw-shaped elongated members (11).

FIG. 7 illustrates telescoping screw-shaped elongated members (11) having at their distal tip (11*b*) a region in which the thread dimensions are varied to facilitate burrowing into a soft penetrable environment.

FIG. 9 illustrates how to drill holes using embodiments of the invention. In FIG. 9*b* a drill bit section (17) is inserted into the drill assembly (15). The drill assembly (15) then drills the drill bit section (17) into the ground or other penetrable environment, thus making a hole. FIG. 9*c*. The hole may be extended by attaching, end-to-end, one or more additional drill bit sections by known methods.

DETAILED DESCRIPTION OF THE INVENTION

Figure 1A:
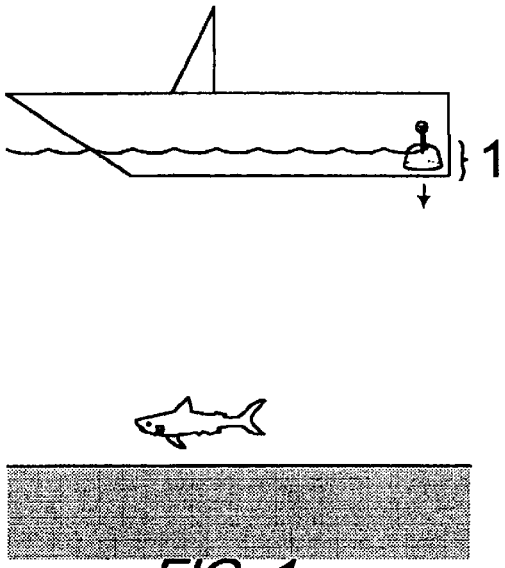
FIG. 1 generally illustrates how an anchor (1) of this invention anchors a boat (in FIG. 1*a*, the anchor (1) is roughly the same scale as the other parts of the drawings.
in FIGS. 1*b*–1*d* the anchor (1) is enlarged for emphasis). An anchor (1) is lowered into a body of water (FIGS. 1*a* and 1*b*) until it reaches a desired location at the sea floor (FIG. 1*c*); elongated members (11) are then extruded from the anchor (1) housing (2) and embedded in the sea floor (FIG. 1*d*).

A. Components, Composition and General Operation of the Invention

The present invention is generally drawn to an anchoring system, comprising:

- a housing (2) having a distal region (2*b*), a proximal region (2*a*) and an interior region (4);
- a connector (7) attached to the housing (2), wherein said connector (7) connects the housing (2) of the anchor (1) to an object;
- at least one motor (9) which is contained within and fixed to said housing (2), wherein said at least one motor (9) is operably linked to at least one power source (10);
- at least three movable elongated members (11), each having a proximal tip (11*a*), a distal tip (11*b*), a retracted storage position and an extended operative position relative to the housing (2), wherein each elongated member is operably linked to at least one motor (9), and wherein an elongated member is essentially contained within the housing (2) when said elongated member is in a storage position and the elongated member extends away from the distal surface (2*b*) of said housing (2) into a penetrable environment when the elongated member is in an extended operative position;

wherein said at least one motor (9) causes an elongated member to move from a storage position to an extended operative position and from an extended operative position to a storage position.

The singular forms "a," "an," and "the" include plural referents unless the context clearly dictates otherwise. For example, the term "an elongated member" encompasses more than one elongated member.

By way of example, the embodiments and figures discussed herein often relate to anchoring a boat. The term "boat" encompasses ships, yachts, catamarans, sailboats, barges, floating seaplanes, and other flotation vessels, especially those that carry one or more persons. However, the invention is not limited to boat anchors.

The housing (2) generally serves to enclose and protect the several components of the anchor (1), to maintain the relative placement of and the working relationships between the components, and to facilitate deployment of the embodiments of the invention. The exact dimensions, material composition, outer shape, and internal architecture of the housing (2) may vary widely with the uses and functions of a particular embodiment. For underwater anchorage of a boat, the housing (2) is made of a material resistant to saltwater corrosion, to collisions with rocks and to submarine pressures of one, two, three, four, five, ten, twenty, or fifty atmospheres. The housing material must be sufficiently dense for all the elements of the anchor to sink to a seafloor, yet be as light as possible for ease of transport and handling. Such materials are known in the art and include: a metal such as titanium or magnesium or a metal alloy such as aluminum or steel, high resistance steel type P, 36.2; or manganese steel alloy; stainless steel type A 315.1, Marine grade quality; or an aluminum/magnesium alloy; or other material or combinations of material having similar density and strength. The housing (2) and other anchor components may be coated to prevent corrosion and adhesion or growth of marine organisms such as barnacles, to better visualize (e.g., bright or phosphorescent paint) or camouflage the anchor against the selected penetrable environment, or for ornamental purposes. Examples of such coatings are known in the art and include enamel, plastic, rubber, zinc metal (commonly known as galvanizing), terne or terne alloy (a metal alloy containing about 80% lead, combined with tin), stainless steel, copper alloys and aluminum, plated tin coating of carbon steel. See also: Herbert H. Uhlig, "Corrosion and Corrosion Control", John Wiley & Sons, 1965, pp. 208–211; Harold Hoffman, "The Complete Metal Finishing Book", H&P Publishing, 1992, pp. 131–154; U.S. Pat. No. 6,652,990, for a "Corrosion-Resistant Coated Metal And Method For Making The Same," U.S. Pat. No. 6,497,772 for a "Surface Treatment For Improved Hardness And Corrosion Resistance;" U.S. Pat. No. 6,277,450 for a "Method And Composition For Preventing Corrosion;" and references cited therein, which are hereby specifically and fully incorporated by reference.

The distal surface (2*b*) of the housing (2) is the portion of the surface that faces the penetrable medium when the anchor (1) is properly deployed. The proximal surface (2*a*) is the region of the housing (2) that is farthest from the distal region (2*b*); it generally is closest to the anchored object and receives the connector (7) and power line (8). To ensure that water anchor embodiments of the invention assume and maintain a desired proximal/distal orientation, the distal surface (2*b*) of the invention is optionally weighted. This is accomplished, for example, by having a thicker shell in cross-section than the proximal surface (2*a*), and/or by including in the distal end (2*b*) a denser material than in the proximal end (e.g., cast steel or cast lead, and/or by concentrating denser and/or heavier components on the distal region of the housing interior (4).

Figures 2A, 2B, 2C, 2D, 2E, 2F:
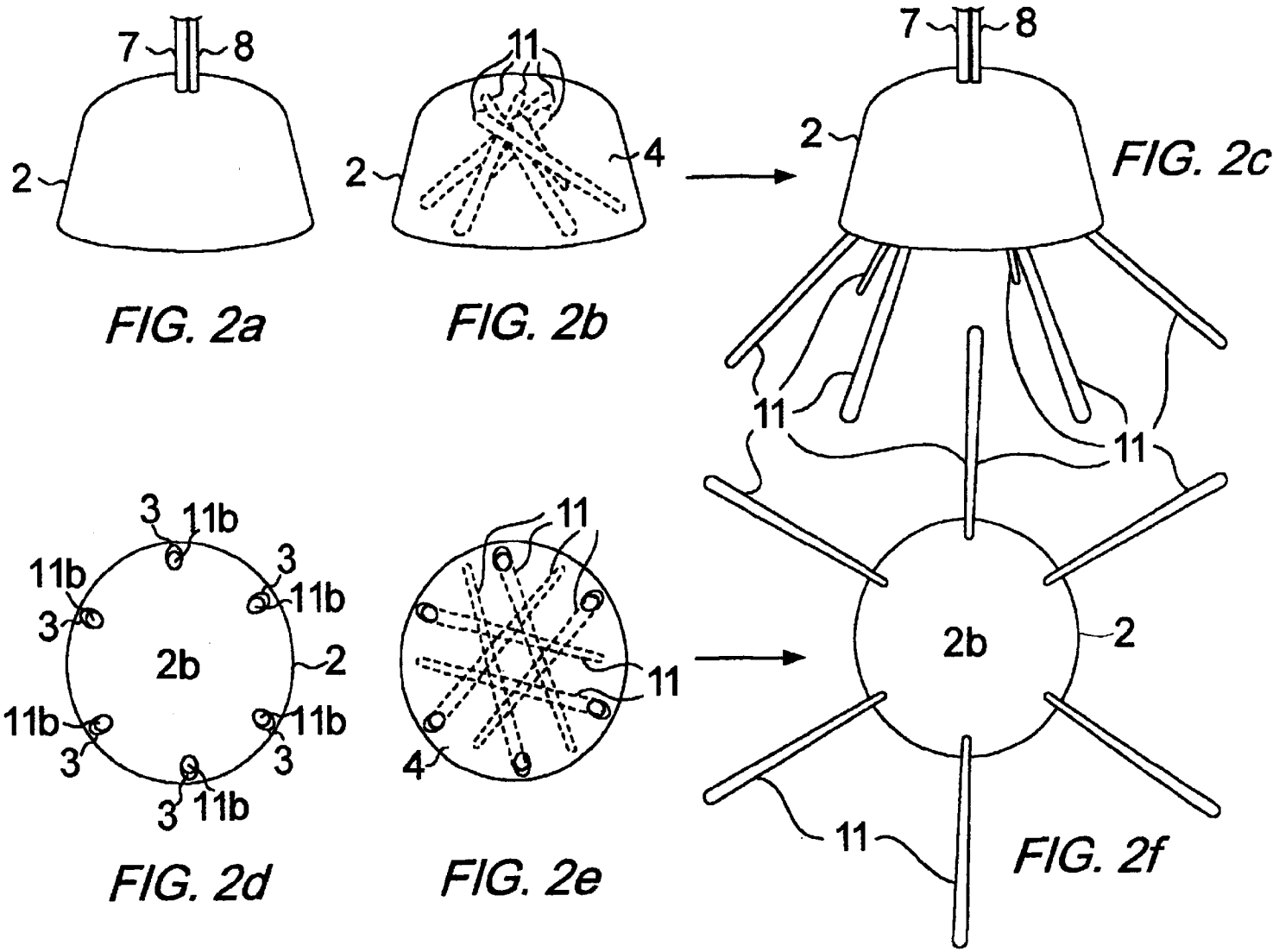

The housing (2) contains at its distal surface (2*b*) an equal number of openings (3) (see FIGS. 2*d* and 2*e*) as there are elongated members (11), through which elongated members (11) can extrude from the interior (4) of the housing (2). In embodiments where an elongated member is a screw; an opening (3) can contain threads that engage or mate with the screw threads of the elongated member and facilitate deployment.

The housing (2) contains in its interior (4) regions or compartments for receiving elongated members (11) in a retracted storage configuration, and watertight compartment (5) to protect water-sensitive components such as motors (9), lights, sensors such as cameras, and beacons. It also contains scaffolding to support and fix the working position and orientation of components such as motors (9), lights and cameras. The specific shape and configuration of the exterior housing surface, interior compartments and scaffolding of different embodiments of the invention can vary with the particular size and intended use of the embodiment. Some land anchor embodiments contain compartments that are readily filled when needed with a material such as water, sand, dirt, gravel, concrete, synthetic polymers, etc., to increase the weight and/or stability of the anchor, and also readily voided of these materials when the anchor is not deployed.

The invention comprises a connector (7) attached to the housing (2), wherein the connector (7) connects the anchor (1) to an object. The connector (7) may be one that is known in the art, for example, a rope, a chain, and a metal or composite cable. The connector (7) is made of a material that has sufficient tensile strength to anchor the intended object (see below) without breaking. Such materials are known in the art (see, e.g., U.S. Pat. No. 4,158,283, entitled Cable Stress And Fatigue Control," U.S. Pat. No. 6,567,591, entitled "Submarine Cable And Method For The Manufacture Thereof," and U.S. Pat. No. 4,644,097, entitled "Armored Submarine Power Cable"). Examples include high tension steel and other metal alloys, titanium, dacron, nylon, polypropylene, kevlar, spectra, and combinations thereof. The connector (7) typically contains two ends. One end of the connector (7) is attached to a region of the housing (2) that is designed to receive the connector (7). For example the housing (2) can include a U-shaped element bolted to the exterior surface of the housing (2), or an arc that is continuous with and shaped directly from the exterior shell of the housing (2). The bolt or arc is preferably located in a recessed region of the proximal surface **(2*a*) of the housing (2). The other end of the connector (7)** is attached to the object that is to be anchored.

The object that is connected to the housing (2) may be a boat, a tree, an electric pole, a tent, any land vehicle (e.g., tractor, fireman's ladder truck, derrick, RV, mobile home, space-ship), an animal (e.g., horse, cow, dog, elephant, camel), a building, a column, a wall, or a bridge. The nature of the connector (7) and its attachment to the object varies with the object.

The term "penetrable environment" refers to any tangible material or environment into which the elongated members (11) of the present invention may be inserted to anchor an object. The term includes, for example, dry land, sea bed, river bed, lake bed, silted areas, marshes, dirt, sand, beach terrain, clay, and the like, and also rock formations, wooden studs, concrete or particle board walls, ceilings or floors, and any natural or man-made objects that are suitable for receiving and securing anchors according to the invention.

Figure 3C:
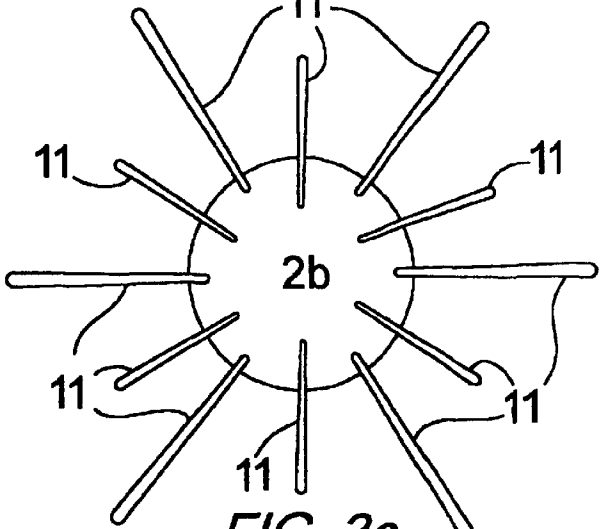
FIG. 3*c* illustrates the bottom view an embodiment having 12 deployed elongated members (11) of varying size and extrusion angle.
Figure 3B:
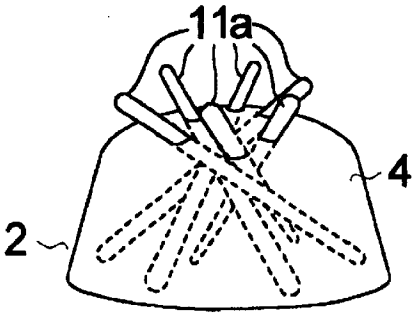
In FIGS. 3*a* and 3*b* the elongated members (11) are longer than the housing (2), so that a proximal region (11*a*) of the elongated members (11) in their storage position protrude from the top exterior surface of the housing (2). Such longer elongated members penetrate more deeply into a penetrable medium.
Figure 3A:
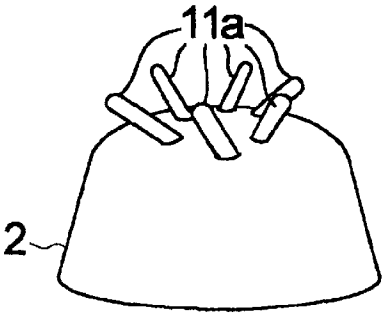
Figure 3F:
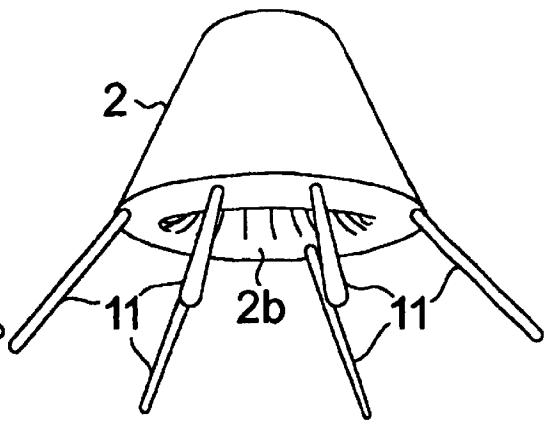
FIGS. 3*d*–3*f* illustrate an embodiment in which the housing (2) generally has a modified torus or donut shape with a central hole and a flattened distal surface or base (FIG. 3*d*, cross-section.
Figure 3E:
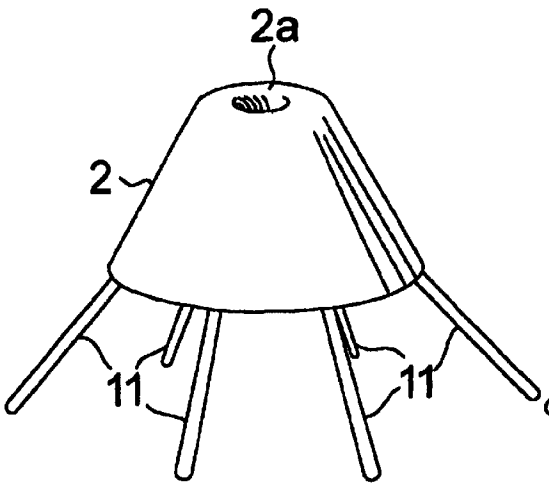
Figure 3D:
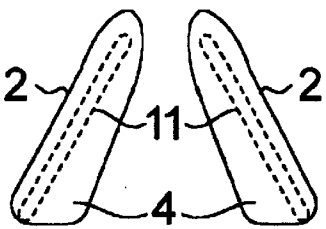
Figure 5B:
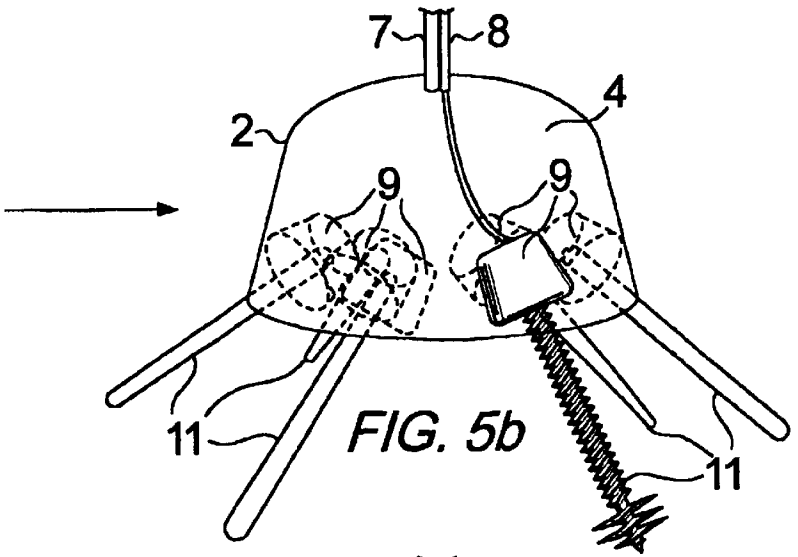
FIG. 5*b* illustrates one way that a motor assembly (9) moves an operably linked screw-shaped elongated member to its extended operable position: a motor assembly (9) surrounds a section of the screw, and mobile portions of the motor (9) (e.g., an internal nut-like rotating element having in a central axial channel screw threads that engage or mate with the threads (12) of the screw-like elongated member) rotate and cause the screw to rotate.
Figure 5A:
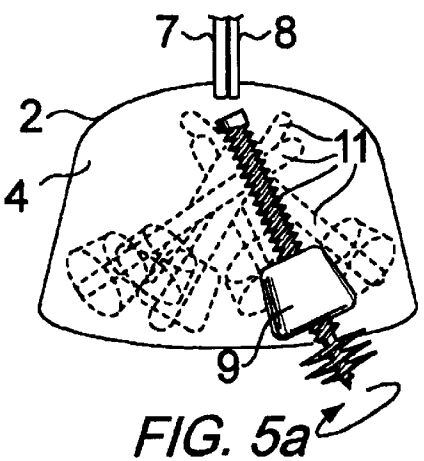
FIG. 5*a* illustrates elongated members (11) in their stowed storage position, each having high to its distal region (11*b*) a motor assembly (9).
Figure 5D:
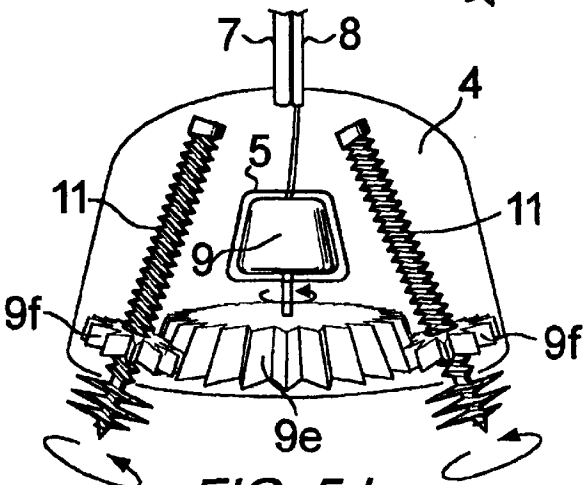
FIG. 5*d* shows how one motor (9) moves more than one elongated member: a motor (9) encased in a water-tight compartment (5) inside the housing (2) uses the power provided by a power line (8) to rotate a central gear (9*e*) which is attached to the motor (9) by a shaft (9*a*); the central gear (9*e*) rotates a plurality of smaller gears (9*e*), each of which is associated with an elongated member; rotation of each smaller gear (9*e*) causes the rotation of the operably linked elongated member.
Figure 5C:
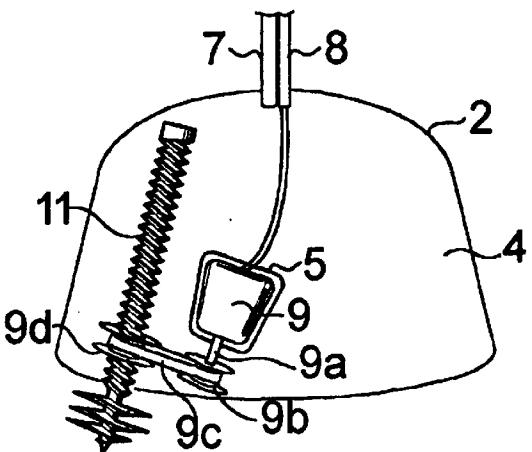
FIG. 5*c* illustrates another way in which a motor assembly rotates and moves a screw-shaped elongated member: a motor (9) encased in a water-tight compartment (5) inside the housing (2) uses the power provided by a power line (8) to rotate a first pulley (9*b*) that is connected to the motor (9) by a shaft (9*a*). The first pulley (9*b*) rotates a belt (9*c*) that connects the first pulley (9*b*) to a second pulley (9*d*). The second pulley (9*d*) encloses and is operably linked to a section of the screw-shaped elongated member (for example, the second pulley (9*d*) has an internal channel having threads that mate with the threads (12) of the elongated member). Rotation of the second pulley (9*d*) rotates the screw.

The term "elongated member" denotes a rod-like element having a roughly cylindrically shaped body, which is sufficiently rigid and has a sufficiently small cross-section to penetrate into a penetrable environment when compelled to do so by a motor (9). The elongated members (11) are mobile elements of the invention; a motor (9) causes each of them to move from a retracted or stowed storage position wherein an elongated member is essentially contained within the housing (2) to an extended operative position wherein an elongated member extrudes from the housing (2). "Essentially contained within the housing" means that at least most of the surface area of a stored elongated member is within the housing (2). In many embodiments, the entire stowed elongated member is within the housing (2). See, e.g., FIG. **2*b*. "Distal tip" is the portion (11*b*) of a fully deployed elongated member that is furthest from the distal housing surface (2*b*) that faces a penetrable environment when the elongated member (11) is extruded from the housing (2) and embedded in the penetrable environment. "Proximal tip" is the portion of the elongated member that is furthest from the distal tip (11*b*) and also closest to the housing (2) when the elongated member (11) is extruded from the housing (2) and embedded in a penetrable environment. In some embodiments, all but the distal tip (11*b*) of a stowed elongated member is in the housing (2). See, e.g., FIG. 5*b*. In others, the elongated members (11) are longer than the housing (2), and the proximal region (11*a*) of the stowed elongated members (11) protrudes at the proximal surface (2*a*) of the housing (2). See, e.g., FIGS. 3*a* and 3*b***.

The exact dimensions, material composition (e.g., stainless steel, titanium, with or without protective coatings), and shape of an individual elongated member (11) may vary widely with the uses and functions of a particular anchor embodiment. For example, dimensions may vary from about 1 mm or less to about five cm or more in diameter and from about 1 cm or less to about 3 meters or more in length.

An anchor (1) invention can include between two and twenty elongated members (11). A single anchor (1) can contain different kinds (e.g, having different cylinder or thread dimensions, different composition, different tip structures, different deployment angles) of elongated members (11).

The angle formed between, on the one hand, the plane of contact between the external surface of the housing (2) and the external surface of the penetrable environment and, on the other hand, an elongated member (11) in its extended operative position, varies between about ten and about one hundred seventy degrees. In some embodiments, the deployed elongated members (11) radiate at a similar angle into the penetrable environment away from the housing (2), like the wires of an umbrella. See FIG. 2. In other embodiments, they radiate at varying angles. See, e.g., FIG. **3*c***.

For example, one embodiment of the invention may have 12 elongated members (11) divided into two groups of six. See, e.g., FIG. **3*c*. The elongated members (11) may all be extruded and retracted in unison, or they may be moved individually or in groups of three, four, five or six. A first group of six may consist of long thick elongated members (11)** having larger threads at the tip suitable for penetrating a soft sandy penetrable environment. The members of a second group may be shorter and thinner an can have, e.g., diamond chips at the tip suitable for drilling into a hard penetrable environment. The operator of the anchor can choose which group to deploy, depending on the looseness or hardness of the particular penetrable environment.

In some embodiments, elongated members (11) are optionally releasable. Thus, the housing (2) and all internal components of a fully deployed anchor may be retrieved, leaving one or more elongated elements embedded in the penetrable medium. This feature is especially useful if for some reason an elongated member (11) becomes stuck after deployment. The unstuck elongated members are retracted and the stuck member is released, so that the anchor can be retrieved.

Figures 4A, 4B, 4C, 4D:
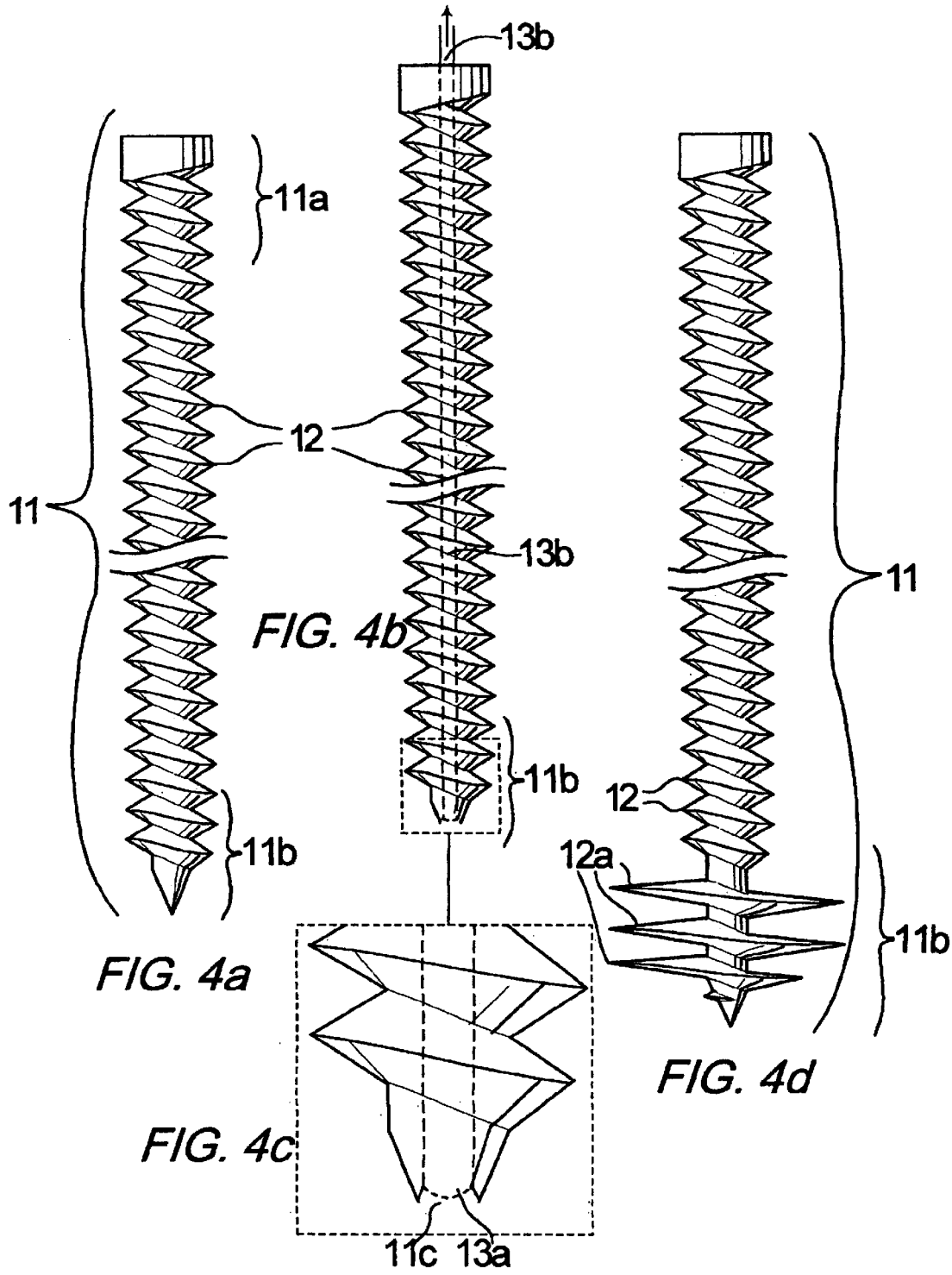
FIG. 4*a* depicts a simple embodiment. The embodiment in FIG. 4*b* contains in a central axial channel an optical fiber for conducting an image located in the center of the screw, which exists at a distal cavity (11*c*) located at the distal tip (11*b*) of the screw (shown at greater magnification in FIG. 4*c*). The embodiment at FIG. 4*d* comprises at its distal tip (11*b*) a region in which the thread dimensions are increased to facilitate burrowing into a soft (e.g., sandy) penetrable environment.

One embodiment of an elongated member (11) is generally shaped like a screw that comprises spiraling threads (12) that project from the cylinder-like side surface of the elongated member (11) (see FIGS. 4 and 5). The composition and dimensions of the elements of a screw of the present invention are selected to facilitate (a) deploying the elongated members (11) and embedding them into the penetrable environment, (b) anchoring objects, and (c) releasing and retrieving the anchor. These dimensions include: diameter and length of the elongated member, thread angle (the angle included between the flanks of a thread measured in an axial plane), thread height (in profile, distance between crest and bottom section of thread measured normal to the axis), thread pitch (the distance from a point on one thread to a corresponding point on the next thread, measured parallel to the axis); pitch diameter (on a straight screw thread, the diameter of an imaginary cylinder where the width of the thread and the width of the space between threads is equal), threads per inch (the number of threads in one inch of length), thread lead (the distance a screw thread advances axially in one turn), thread lead angle (the angle made by the helix of the thread at the pitch diameter, with a plane perpendicular to the axis), root (the bottom surface joining the flanks of two adjacent threads), side or flank of thread (the surface of the thread which connects the crest with the root), major diameter (the largest diameter of the screw or nut on a straight screw thread), minor diameter (the smallest diameter of the screw or nut on a straight screw thread), allowance (the minimum clearance or maximum interference which is intended between mating parts), chamfer (the tapered and relieved cutting teeth at the front end of the threaded section).

Figure 7A:
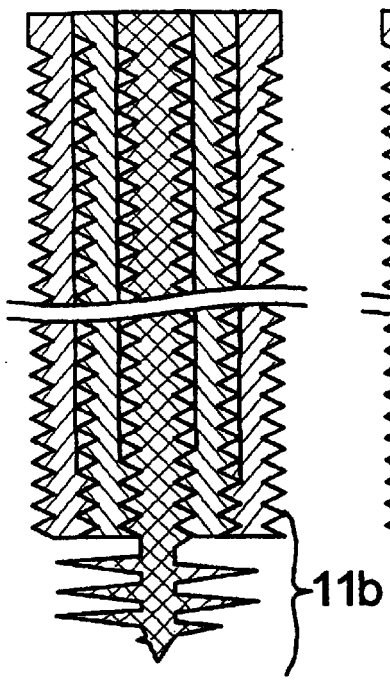
FIG. 7*a* depicts the cross section of a telescoping screw in which the three layers of the particular embodiment are completely retracted.
Figure 7B:
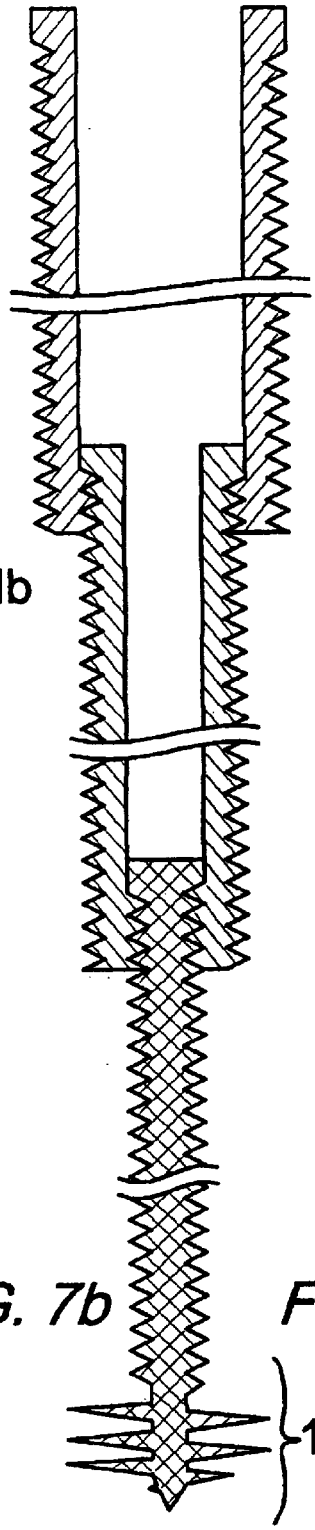
FIG. 7*b* is a cross-section in which the three layers are completely extended or deployed.
Figure 7C:
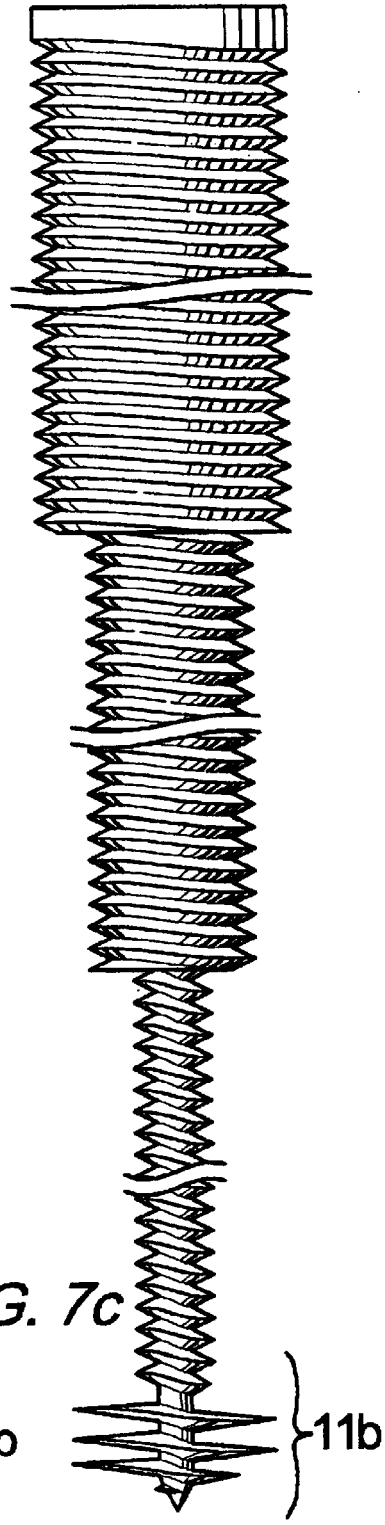
FIG. 7*c* is a surface view of a fully extended or deployed telescoping screw.
Figure 8B:
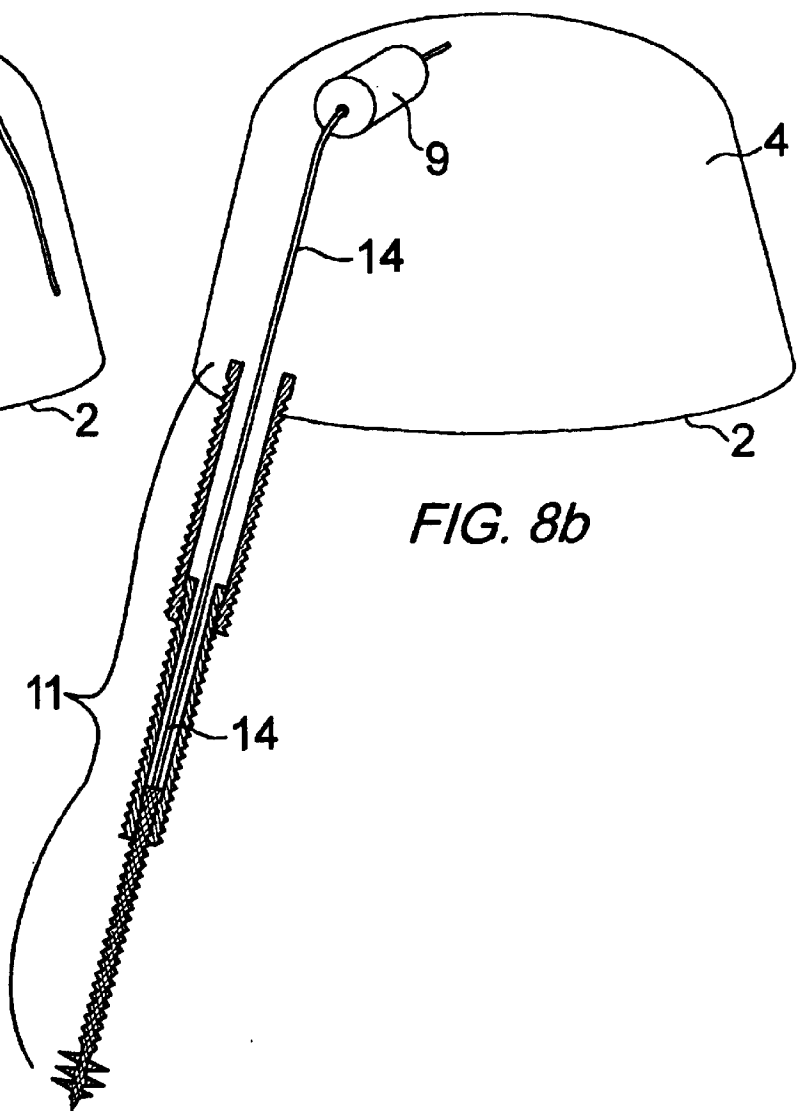
FIG. 8 illustrates an embodiment in which a telescoping screw having a modified distal tip (11*b*) is deployed. The proximal tip of the inner layer of a telescoping screw-shaped elongated member is attached to, or is continuous with, an axially bendable, rotationally rigid shaft (14) which may have, e.g., a cylindrical, or polygonal (e.g., square, pentagonal, hexagonal), or flattened cross-section. The rotationally rigid shaft (14) is operably linked to a motor assembly (9). The motor assembly (9) rotates and also translates (moves axially) the shaft (14), which causes the inner and outer layers of the screw to rotate and move to the fully extended operative position. Please note that although the figure depicts only one motor assembly, there may be two motors acting in tandem, one that rotates and the other that translates the shaft.
Figure 8A:
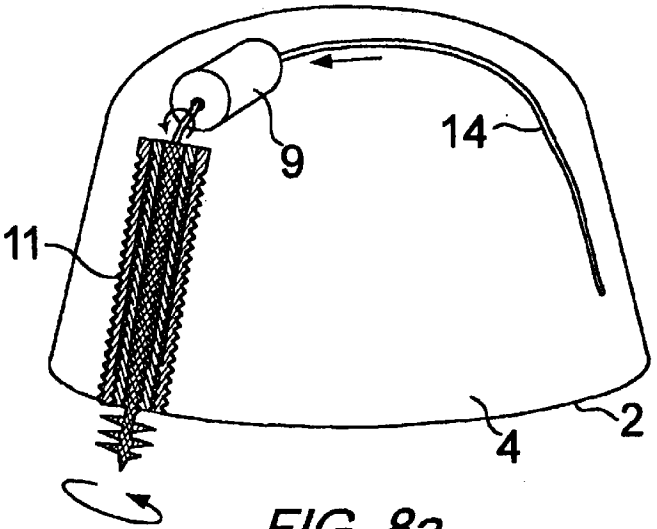

The head and tip structures of the elongated members of the present invention are designed to efficiently engage a motor (9) and to better penetrate into a penetrable medium. For example, in FIGS. 5, 8*a* and 8*b*, the proximal end is modified to include a rod (14) that is operably linked to a motor. Also, the distal tip (11*b*) is the first part of an elongated member (11) to contact and penetrate into whatever penetrable medium is used to anchor an object. In certain embodiments such as those depicted in FIGS. 4*d*, 5 and 7, the threads of the distal tip (11*b*) are modified to ease penetration into a soft or sandy penetrable medium. In other embodiments, diamond chips are embedded in the distal tip to facilitate penetration into a hard penetrable medium such as rock. Other variations are possible. A cursory internet search readily disclosed many websites describing drill bits having different designs for different uses, for example: www.sandia.gov/geothermal/Programs/drillbit22.htm, www.bobvila.com/ProductServices/SmartBuys/SmartDirectory/Tools-PowerToolAccessories-DrillBits_and_Sets, www.jfoakes.com/Drill%20Bits.htm, www.coastaltool.com/a/bosc/bospline.htm.

The suitability of an anchor embodiment for a particular use (mainly a function of the nature of the penetrable environment and of the anchored object), are readily ascertained by measuring, using well-known devices and methods, the power, torque, axial pressure and stress on anchor components required to embed anchors having a chosen number of motors and of elongated members with chosen deployment angles, thread dimensions, and tip structures in a chosen penetrable environment. The criteria for suitably are (1) that the elongated members are successfully embedded in the chosen penetrable environment and then readily retracted, and (2) that this is accomplished with an efficient expenditure of power, torque, axial pressure and tolerable stress on anchor components.

Figure 6A:
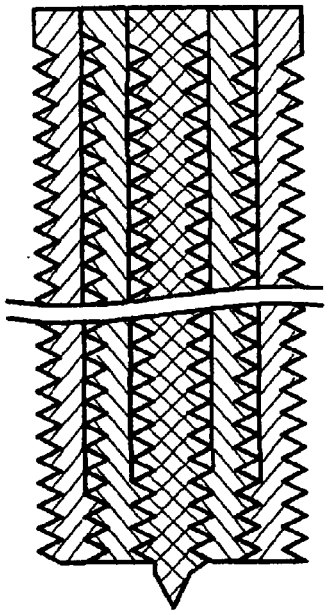
FIG. 6*a* depicts the cross section of a telescoping screw in which the three layers of the particular embodiment are completely retracted.
Figure 6B:
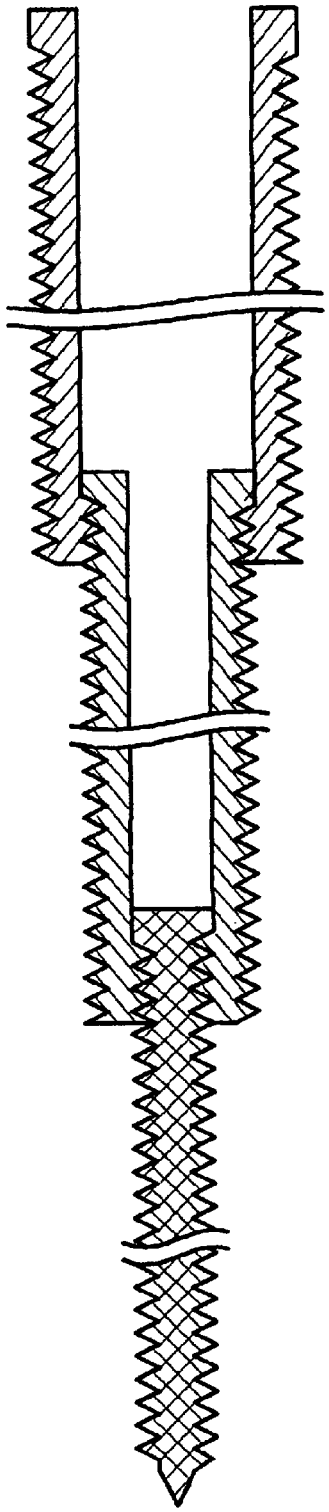
FIG. 6*b* is a cross-section in which the three layers are completely extended or deployed.
Figure 6C:
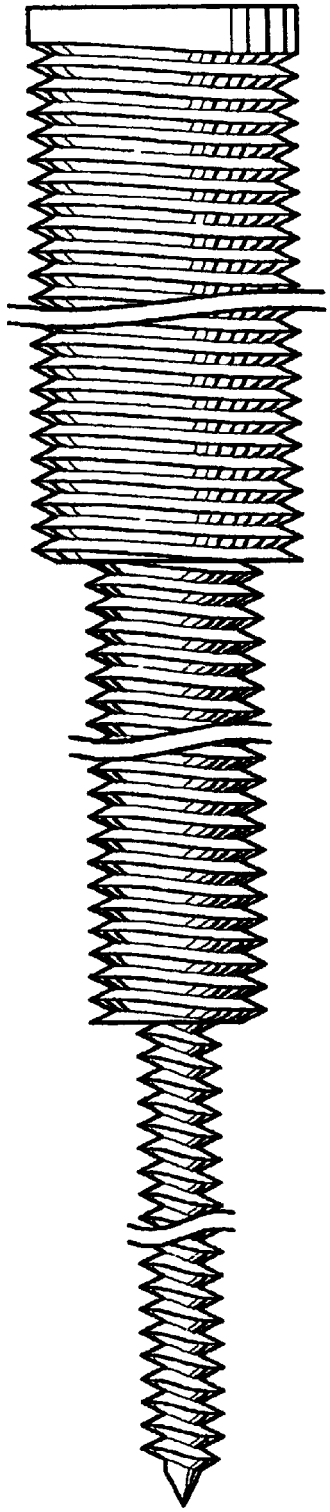
FIG. 6*c* is a surface view of a fully deployed, extended telescoping screw.

A "telescoping screw" is a screw having multiple layers, each inner layer having on its outermost side surface spiral threads that "mate with" or engage spiral threads present on the innermost surface of an immediately surrounding layer. See FIGS. 6 and 7. Rotation of an inner layer in one direction causes the inner layer to extend in the direction of the long axis of the screw relative to an immediately surrounding layer, until all layers move into an extended operative position. See FIG. 7. Rotation in the opposite direction causes an inner layer to retract into the immediately surrounding layer until all layers are moved into a retracted storage position.

Telescoping drills and screws having different designs from the telescoping screws of the present invention are known in the art. U.S. Pat. No. 4,561,812 to Linden describes an extensible drill assembly comprising a plurality of separate drill members having different drill diameters which are arranged to permit assembly of two or more of the drill members into a continuous drill combination having a stepwise increasing diameter from the outermost drill member. U.S. Pat. No. 5,168,944 describes a telescopically extensible drill. U.S. Pat. No. 5,007,487 describes an apparatus for making drill holes under spatially restricted conditions, which comprises a drill rod consisting of individual segments that are pushed into each other in such a manner that the necessary torques and pressure forces can be effectively transmitted from the drilling motor. U.S. Pat. No. 5,943,910 describes a telescopic ball nut and screw linear actuator having both extend and retract modes. U.S. Pat. No. 5,131,475 describes a system for controlling drilling force of a telescoping rock drill.

The term "motor" generally means a device for using energy to perform work, wherein "work" particularly means moving an elongated member from a storage position to an operative position and vice versa. The term motor further encompasses all physical components (e.g., coil, turbine, crankshaft, gear, hydraulic line) needed to harness the motive force generated by the particular kind of motor to move an elongated member. How the motive force results in movement is not critical, as long as it readily occurs at will. Thus, the motor is any known in the art, such as an electric motor and a hydraulic motor. Generally, a motor (9) is fixed in the interior (4) of the housing (2), wherein at least certain components of the motor (9) are typically inside a watertight compartment (5). In one embodiment, the motor (9) is activated via direct wire connections. In another, the motor (9) is operationally linked to a receiver for receiving a remote signal, and the motor (9) is activated by remote control.

The phrase "at least one motor" means a number of motors (9) that ranges from one to a number that equals the number of elongated members (11) plus one. When there is more than one motor (9), they may be of different kinds (e.g., electrical, hydraulic, etc.) or the same kind.

The term "operably linked" generally denotes that the operably linked components are connected to each other, either directly or through intermediate structures such a gears, so that the components can perform a prescribed function. The phrase "motor . . . operably linked to at least one power source" denotes that a motor (9) is connected to a power source (10) in such a way that power (energy) flows from the power source (10) to the motor (9), enabling the motor (9) to perform work. Typically, the motor (9) is connected to the power source (10) by a power line (8) comprises insulated (e.g., copper) wires form a conducting circuit. The phrase "elongated member . . . operably linked to at least one motor" denotes that an elongated member is connected to at least one motor (9), either directly or indirectly (for example, via gears or motor shaft) so that the motive force of the motor (9) moves the elongated member (11).

A motor (9) is generally operatively linked to an end or a side of an elongated member (11). These ends and/or cylindrical sides of the elongated member can be modified to better engage the motor (9) and more efficiently use the motor's motive force to move the elongated member. For example, the distal tip may be shaped to engage a component of the motor (9), or it may comprise a flexible rod having a round, hexagonal, or flattened cross-section. See, e.g., FIG. 7.

Some embodiments of the anchor (1) include a sensor for monitoring the environment of the anchor. For example, an anchor may include at least one camera (13) for visualizing the remote and otherwise unseen penetrable environments such as the sea floor. The precise construction of the camera (13) is not critical, so long as it allows the anchor operator to view the immediate environment of the anchor (1) with sufficient precision to control its desired placement and deployment. Underwater cameras and camera components that may be adapted for inclusion in the present invention include those described in: U.S. Pat. No. 6,574,435, entitled "Underwater Camera Housing Having Sealed Pivotable Shutter Actuator And Method;" U.S. Pat. No. 6,574,429, entitled "Underwater Camera Having Viewports Bearing On Viewfinder Tunnel Of Frame;" U.S. Pat. No. 6,154,610, entitled "Housing And Control Unit For Underwater Camera;" U.S. Pat. No. 6,061,522, entitled "Flash Lamp Usable Both As A Main And As A Slave And Connector Therefor To An Underwater Camera;" U.S. Pat. No. 5,826,113, entitled "Auto-Focusing Camera Capable Of Photographing In Water;" U.S. Pat. No. 5,519,540, entitled "Taking Lens For Underwater Camera;" U.S. Pat. No. 5,257,137; entitled "Photo-Taking Lens For An Underwater Camera;" U.S. Pat. No. 5,239,324, entitled "Underwater Housing And An Underwater Taking Camera;" U.S. Pat. No. 5,185,671, entitled "Adaptive Control Of An Electronic Imaging Camera;" U.S. Pat. No. 5,166,714, entitled "Underwater Camera Having Through-The-Lens Viewing;" U.S. Pat. No. 4,381,144, entitled "Underwater Camera Enclosure Including Sonar Range Finding Device," U.S. Pat. No. 4,326,785, entitled "Camera Having A Connector Common To A Flash Bulb Unit And An Electronic Flash Unit;" U.S. Pat. No. 4,300,215, entitled "Wide Angle Acoustic Camera" and patent document D307,155, entitled "Remote Controlled Underwater Camera."

The camera or cameras allow the operator to choose favorable anchoring sites and avoid unfavorable ones, and to correctly position the anchor (1) at a desired underwater location. A camera (13) is typically located in a watertight compartment (5) within the housing (2), with a remote lens located at some point on the outside surface of the anchor system. In one embodiment, a lens **(13*a*) of a camera is located in a recessed cavity (11*c*) at the distal tip (11*b*) of an elongated member (11), and a long conduit (13*b*) such as an optical fiber conducts the image through a central groove in the elongated member (11) to a distal viewing site. See, e.g., FIG. 4*b*. The lens is preferably a wide-angle lens for visualizing a larger area. The camera (13) optionally detects a desired range of wavelengths, including visible light and wavelengths not ordinarily detected by the human eye (e.g., infrared, ultraviolet, radio waves, etc.). The camera (13)** also optionally contains a microprocessor for high-resolution analysis and enhancement of the detected image.

Since the sea floor is typically dark, particularly at night, an anchor (1) of the invention is optionally provided with at least one light source operably linked to a power source (10). The light source emits light having a selected range of wavelengths (including visible light and wavelengths not ordinarily detected by the human eye, e.g, infrared, ultraviolet, radio waves, etc.) and intensity. A light source may be placed anywhere in or on the housing (2) or the connector (7), although it preferably points to areas underneath the distal surface **(2*b*)** of the anchor or to the side of the anchor.

In general, a person controls deployment of an anchor of this invention at will. However, computers or machines may alternatively control deployment. For example, in one embodiment, if a cable for towing a barge or anchoring a boat breaks, an emergency system (preferably computerized) automatically deploys an anchor of the invention.

B. Uses of the Invention

Figure 1B:
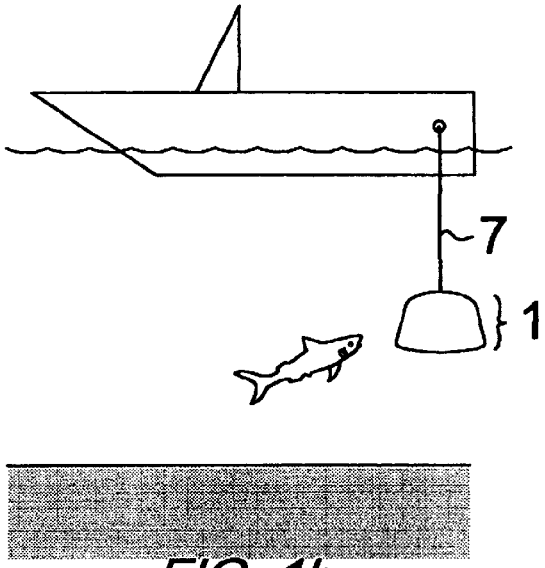
Figure 1C:
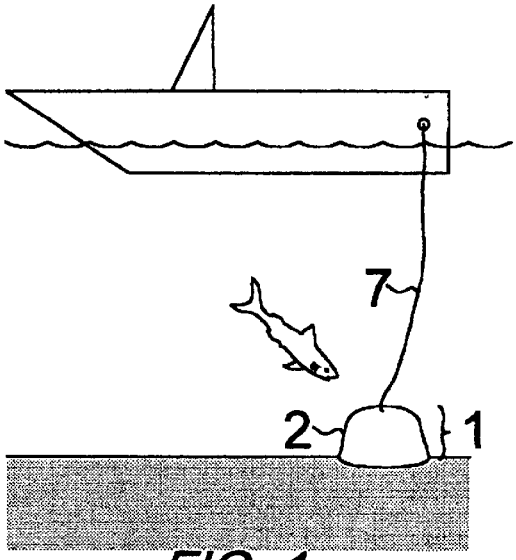
Figure 1D:
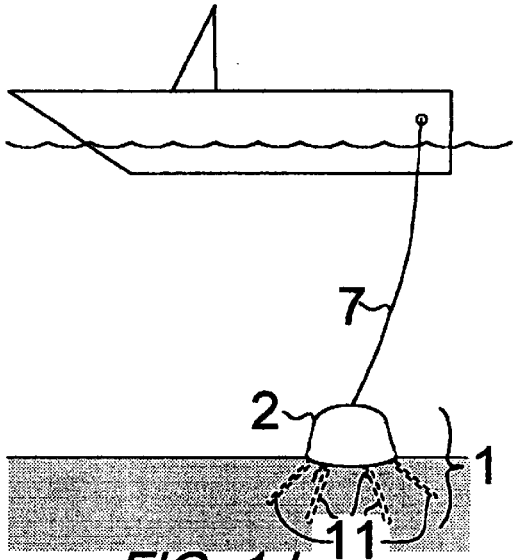

FIG. 1 generally illustrates how an anchor (1) of this invention anchors a boat (in FIG. **1*a*, the anchor (1) is roughly the same scale as the other parts of the drawing; in FIGS. 1*b*–1*d* the anchor (1) is enlarged to focus on the anchor (1)). an anchor (1) is lowered into a body of water (FIGS. 1*a* and 1*b*) until it reaches a desired location at the sea floor (FIG. 1*c*); a number of elongated members (11) are then extruded from the anchor housing (2) and embedded in the sea floor (FIG. 1*d***).

The water anchor embodiments off the present invention overcome the noted disadvantages of existing water anchors. The (a) roughly rounded, donut or hemispherical shape of certain embodiments, (b) ability to efficiently engage the penetrable sea bed environment and also (c) the functional features (for example, the use of a camera (13) in some embodiments) of the illustrative embodiments dramatically minimize dragging, snagging and destruction of undersea habitats such as coral colonies. The at-will, directed deployment of the elongated members (11), and the ability to readily penetrate a variety of marine substrata, avoids the serendipitous hit-or-miss approach to anchoring that results in multiple maddening failed attempts. The angled and radial orientation and planned penetration of the elongated members (11) of the anchors resists accidental dislodgment and prevents unwanted drifting. Lifting anchor is significantly easier because the anchoring elements, the elongated members (11), are readily withdrawn at will from the penetrable environment and the chance of snagging is minimal. There is therefore essentially no need to cut a line and lose an anchor.

Certain embodiments of this invention may be used in applications other than for anchoring boats. For example, land anchor embodiments may be used for tethering a tree, an electric pole, a tent, any land vehicle (e.g., tractor, fireman's ladder truck, crane, oil drill, derrick, mobile home), an animal (e.g., horse, cow, dog, elephant, camel), a building, a wall, or a pontoon of a bridge. These anchors are particularly useful for stabilizing the anchored objects when there is a strong grade angle, wind or current.

Figures 9A, 9B, 9C, 9D, 9E:
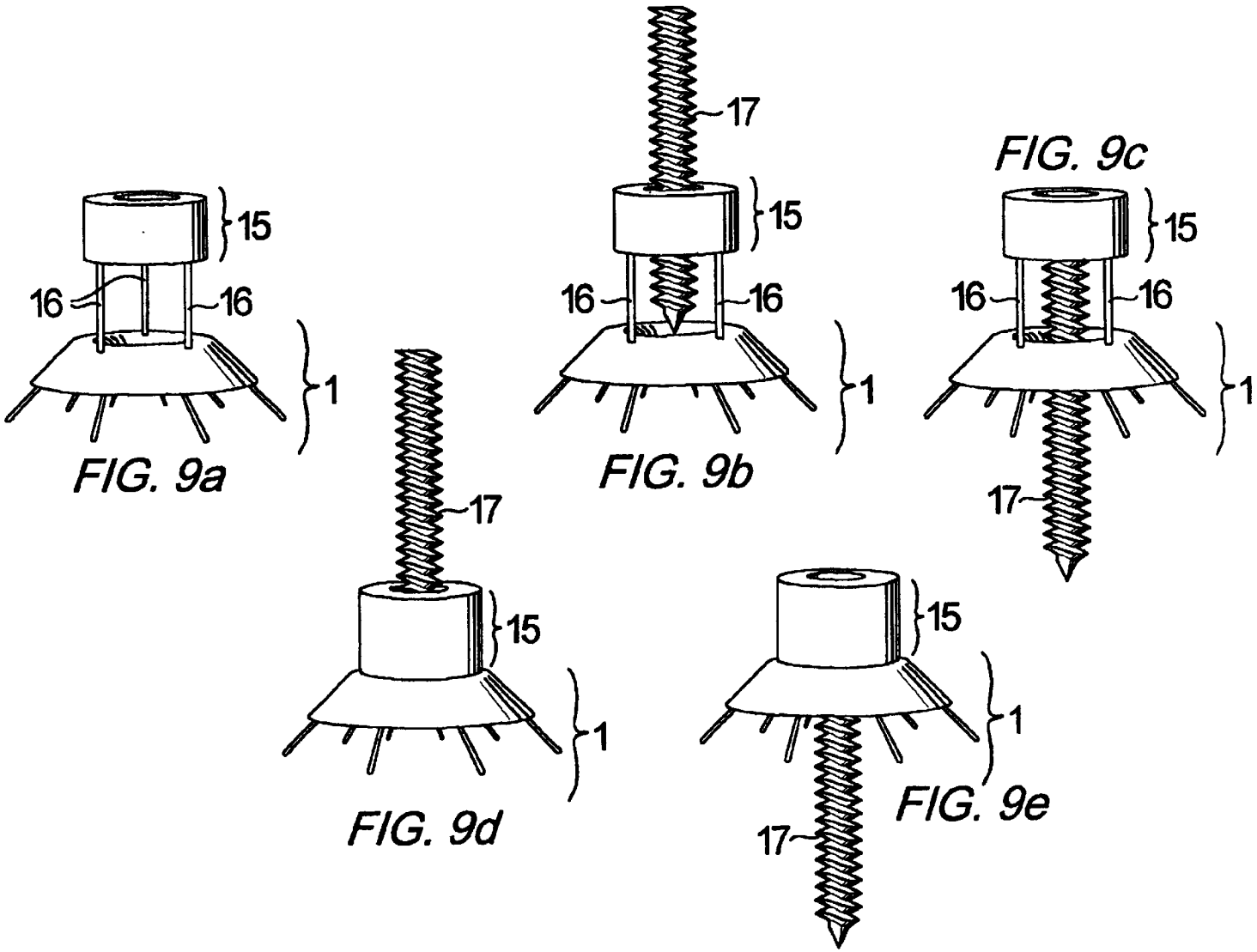
FIGS. 9*a*–9*c* depict an anchor (1) of the present invention with fully deployed elongated members (11), to which a drill assembly (15) is attached by support elements (16).
FIGS. 9*d* and 9*e* depict an embodiment in which the drill assembly (15) is directly attached to an anchor (1) of the present invention.

Modified anchors within the scope of this invention can also facilitate drilling holes in a variety of environments (e.g., land or underwater) and for a variety of purposes (e.g., sampling soil from different strata, drilling holes for light posts, drilling water wells, drilling oil wells, laying pipes for gas, water, electricity, or fiber optic networks). The modification consists of attaching a drill assembly to a donut-shaped housing embodiment of the present invention having a central cavity. FIG. 9 illustrates how embodiments of the invention are used to drill holes. FIGS. **9*a*–9*c* depict an anchor (1) of the present invention with fully deployed elongated members (11), to which a drill assembly (15) is attached by support elements (16). In FIG. 9*b* a drill bit section (17) is inserted into the drill assembly (15). The drill assembly (15) then drills the drill bit section (17) into the ground or other penetrable environment, thus making a hole. FIG. 9*c*. One may extend the hole by attaching, end-to-end, one or more additional drill bit sections. FIGS. 9*d* and 9*e* depict an embodiment in which the drill assembly (15) is directly attached to an anchor (1)** of the present invention.

In addition, yet other embodiments are useful for laying pipes (electrical lines, water lines, gas lines, fiber-optic lines, etc.) under pavement. Current methods call for digging long trenches in public thoroughfares, removing debris, laying pipes, and then re-paving. These methods are wasteful of paving materials and man-hours, they obstruct vehicular and human traffic, they raise dust and create health and accident hazards for the community, and they require disposal of excavated debris. FIG. 10 illustrates how an anchor system embodiment can be used to make holes laterally under a pavement (e.g., concrete, asphalt, etc.) with less effort, disruption, hazard, and waste. This embodiment comprises a roughly donut-shaped anchor (1), a drill assembly (15) attached thereto, and optionally a built-in jack (18). See FIG.

Figure 10A:
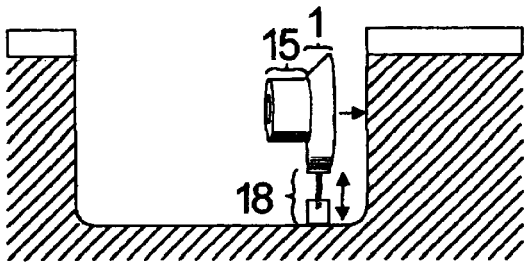
FIG. 10 illustrates how an anchor system embodiment can be used to make holes laterally under a pavement (e.g., concrete, asphalt, etc.). This embodiment comprises a roughly torus-shaped anchor (1) with a central hole and a flattened surface that contacts a wall, a drill assembly (15) attached thereto, and an optional built-in jack (18). See FIG. 10*a*. The embodiment is placed in a hole that has been dug by any means and placed beneath the level of the pavement facing a side wall of the hole. The jack (18) positions the anchor (1) and drill assembly (15) at a desired height (FIG. 10*a*), and the anchor is pressed against a wall of the hole. The elongated members (11) of the anchor (1) are deployed to fasten the anchor (1) and attached drill assembly (15) to the wall.
FIG. 10*b*. A bracing assembly may optionally be deployed to press the anchor against the wall, wherein the bracing assembly comprises a bracing element (19), two or more support elements such as rods (20) that connect the bracing element (19) to the drill (15) and/or anchor (1), and optionally a jack (21) to position the bracing element (19) at a chosen height.
FIG. 10*c*. A drill bit section (17) is operably linked to (e.g., inserted into) the drill assembly (15) and drilled into the wall (FIG. 10*d*; the optional bracing assembly is omitted for the sake of simplicity). Additional drill bit sections (17) are serially appended (FIG. 10*e*) as needed until the desired hole length is achieved. In some instances, the drill bit sections (17) are hollow, and materials such as pipes and cables are passed through the hollow axial channel (see FIG. 10*f*); the drill bit sections are removed, leaving the pipe or cable in place inside the drilled hole. By using multiple such embodiments, it is possible to drill holes of desired length (see FIGS. 10*g*–10*h*) without having to first rip out the entire pavement, thus economizing paving materials and man-hours.
Figure 10B:
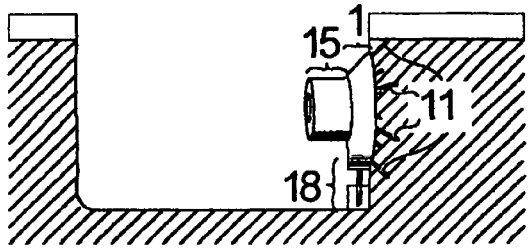
Figure 10C:
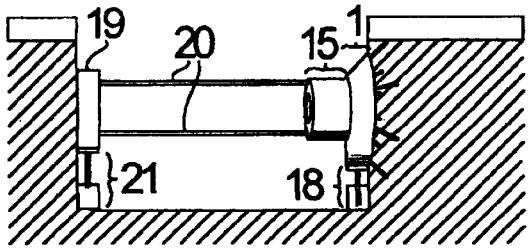
Figure 10D:
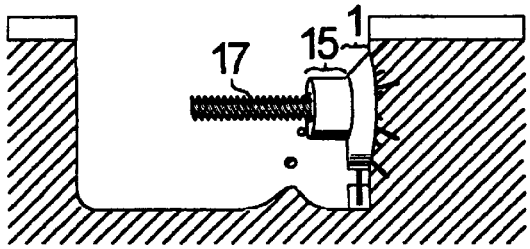
Figure 10E:
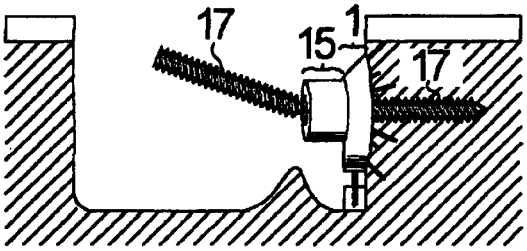
Figure 10F:
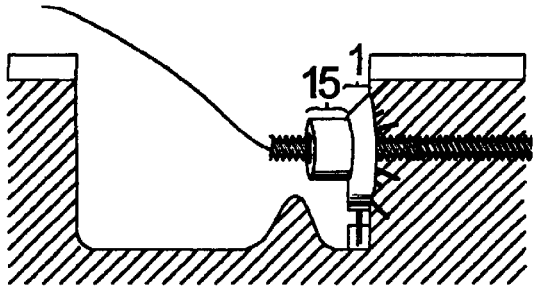
Figure 10G:
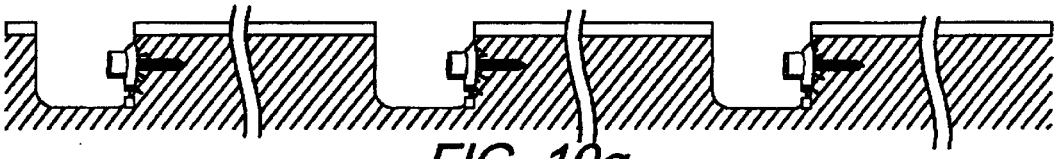
Figure 10H:
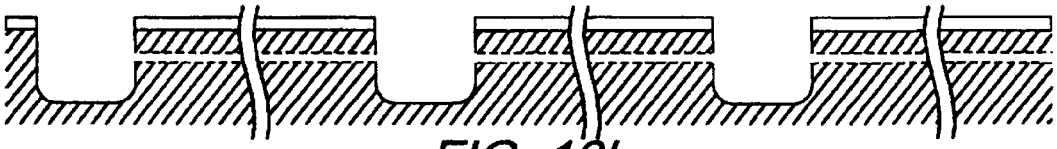

10*a*. The drill assembly may be any that is used for digging holes and wells, modified so as to interact with the other elements of the embodiment. The embodiment is placed in a hole that has been dug by any means and placed beneath the level of the pavement facing a side wall of the hole. The jack (18) positions the anchor (1) and drill assembly (15) at a desired height (FIG. 10*a*), and the anchor is pressed against a wall of the hole. The elongated members (11) of the anchor (1) are deployed to fasten the anchor (1) and attached drill assembly (15) to the wall. FIG. 10*b*. A bracing assembly may optionally be deployed to press the anchor against the wall, wherein the bracing assembly comprises a bracing element (19), two or more support elements such as rods (20) that connect the bracing element (19) to the drill (15) and/or anchor (1), and optionally a jack (21) to position the bracing element (19) at a chosen height. FIG. 10*c*. A drill bit section (17) is operably linked to (e.g., inserted into) the drill assembly (15) and drilled into the wall (FIG. 10*d*; the optional bracing assembly is omitted for the sake of simplicity). Additional drill bit sections (17) are serially appended (FIG. 10*e*) as needed until the desired hole length is achieved. In some instances, the drill bit sections (17) are hollow, and materials such as pipes and cables are passed through the hollow axial channel (see FIG. 10*f*); the drill bit sections are removed, leaving the pipe or cable in place inside the drilled hole. By using multiple such embodiments, it is possible to drill holes of desired length (see FIGS. 10*g*–10*h*) without having to first rip out all the pavement, thus economizing paving materials and man-hours.

The present invention is not limited to the specific embodiments and features described above. This document and/or the unique combination of publications selected for discussion herein (all of which are hereby fully incorporated by reference), may spark a person of ordinary skill to conceive of variations that are not specifically described. The invention is thus claimed in any of its forms or modifications within the proper scope of the appended claims, appropriately interpreted in accordance with the doctrine of equivalents.

What is claimed is:

1. An anchoring system, comprising:

a housing comprising a distal region, a proximal region and an interior region;

a connector attached to the housing, wherein said connector connects the housing to an object;

at least one motor which is contained within and fixed to said housing, wherein said at least one motor is operably linked to at least one power source;

at least three movable elongated members, each member comprising a proximal tip and a distal tip and having a retracted storage position and an extended operative position relative to the housing, wherein each elongated member is operably linked to at least one motor, and wherein said elongated member extends away from the distal surface of said housing into a penetrable environment when the elongated member is in an extended operative position.

2. An anchoring system according to claim 1, wherein the elongated members are shaped like screws.

3. An anchoring system according to claim 1, wherein said elongated members are telescoping screws having multiple layers, wherein an inner layer extends beyond an immediately surrounding outer layer when a telescoping screw is deployed into an extended operative position, and wherein an inner layer retracts into an immediately surrounding layer when a telescoping screw is in a storage position.

4. An anchoring system according to claim 1, comprising a number of elongated members selected from the group of numbers that consists of three, four, five, six, seven, eight, nine, ten, eleven, twelve, thirteen, fourteen, fifteen, sixteen, seventeen, eighteen, nineteen, and twenty.

5. An anchoring system according to claim 1, comprising a number of motors that is equal to the number of elongated members, wherein each motor is operably linked to a power source and to an elongated member and the motor causes the linked elongated member to move from a retracted storage position to an extended operative position and from an extended operative position to a storage position.

6. An anchoring system according to claim 1, wherein said power source is contained within said housing.

7. An anchoring system according to claim 1, wherein said power source is remote and the power source is operably linked to said at least one motor via a power line.

8. An anchoring system according to claim 1, wherein the distal tip of an elongated member further comprises a region in which the thread angle, thread height, thread pitch; pitch diameter, threads per inch, thread lead, and thread lead angle are varied to facilitate penetration into a sandy or muddy penetrable medium.

9. An anchoring system according to claim 1, further comprising at least one camera.

10. A method of anchoring an object, comprising the steps of:

(a) positioning an anchor against a penetrable medium, wherein said anchor comprises:

a housing having a distal surface region, a proximal surface region and an interior region;

a connector attached to the housing, wherein said connector connects the housing of the anchor to an object;

at least one motor which is contained within and fixed to said housing, wherein said at least one motor is operably linked to at least one power source;

at least three movable elongated members wherein each elongated member is operably linked to at least one motor, each elongated member comprising a proximal tip and a distal tip and having a retracted storage position and an extended operative position relative to the housing, wherein an elongated member extends away from the distal surface of said housing into a penetrable environment when the elongated member is in an extended operative position, (b) causing said at least one motor to move an operably linked elongated member from a storage position to an extended operative position in which each elongated member extends from said housing into said penetrable medium.

11. A method according to claim 10, wherein said elongated members are shaped like screws.

12. A method according to claim 10, wherein said elongated members are telescoping screws having multiple layers, wherein said at least one motor causes an inner layer to extend beyond an immediately surrounding layer or to retract into an immediately surrounding layer.

13. A method according to claim 10, wherein the anchor comprises a number of elongated members selected from the group of numbers that consists of three, four, five, six, seven, eight, nine, ten, eleven, twelve, thirteen, fourteen, fifteen, sixteen, seventeen, eighteen, nineteen, and twenty.

14. A method according to claim 10, wherein the anchor comprises a number of motors that is equal to the number of elongated members, wherein each motor is operably linked to an elongated member and causes said linked elongated member to move from a storage position to an extended operative position and from an extended operative position to a storage position.

15. A method according to claim 10, wherein said method further comprises causing said at least one motor to move each operably linked elongated member from an extended operative position to a retracted storage position.

16. A method according to claim 10, wherein the anchor further comprises a camera, and the method further comprises using the camera to monitor and direct positioning of the anchor relative to the penetrable medium.

* * * * *